United States Patent [19]

Osawa

[11] Patent Number: 4,516,373

[45] Date of Patent: May 14, 1985

[54] APPARATUS FOR TILE-SETTING

[76] Inventor: Yoshinori Osawa, 178, Oazasagami, Koga-cho, Koga-gun, shiga, Japan

[21] Appl. No.: 435,395

[22] Filed: Oct. 19, 1982

[30] Foreign Application Priority Data

Oct. 26, 1981 [JP] Japan ..... 56-171620
Dec. 9, 1981 [JP] Japan ..... 56-183842

[51] Int. Cl.[3] ..... E04F 13/08
[52] U.S. Cl. ..... 52/387; 52/488; 52/710; 52/480
[58] Field of Search ..... 52/387, 384, 385, 386, 52/388, 389, 390, 391, 710, 392, 480, 481, 488, 136, 235

[56] References Cited

U.S. PATENT DOCUMENTS

| | | | |
|---|---|---|---|
| 1,975,769 | 10/1934 | Cederholm | 52/387 |
| 2,191,267 | 2/1940 | Willson | 52/387 |
| 3,319,983 | 5/1967 | Zibell | 52/488 |
| 3,412,515 | 11/1968 | Finon | 52/480 |
| 3,903,671 | 9/1975 | Cuin et al. | 52/480 |
| 4,107,887 | 8/1978 | Wendt | 52/512 X |
| 4,170,859 | 10/1979 | Counihan | 52/391 X |

*Primary Examiner*—John E. Murtagh
*Assistant Examiner*—Kathryn Ford
*Attorney, Agent, or Firm*—Wenderoth, Lind & Ponack

[57] ABSTRACT

An apparatus for setting tiles on the surface of plaster comprises a plurality of vertical bars joined at regular intervals by a plurality of horizontal bars that serve as rests for the tiles. Each horizontal bar is held in place by a pair of horizontal bar holders mounted on the adjacent vertical bars.

3 Claims, 23 Drawing Figures

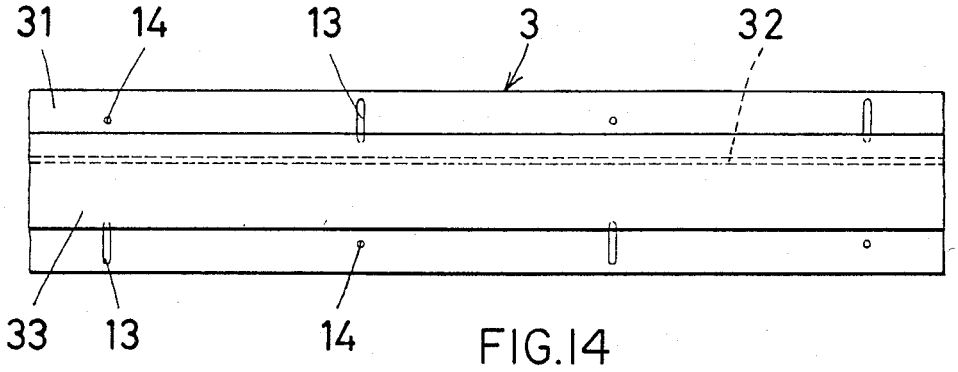
FIG.14
FIG.15
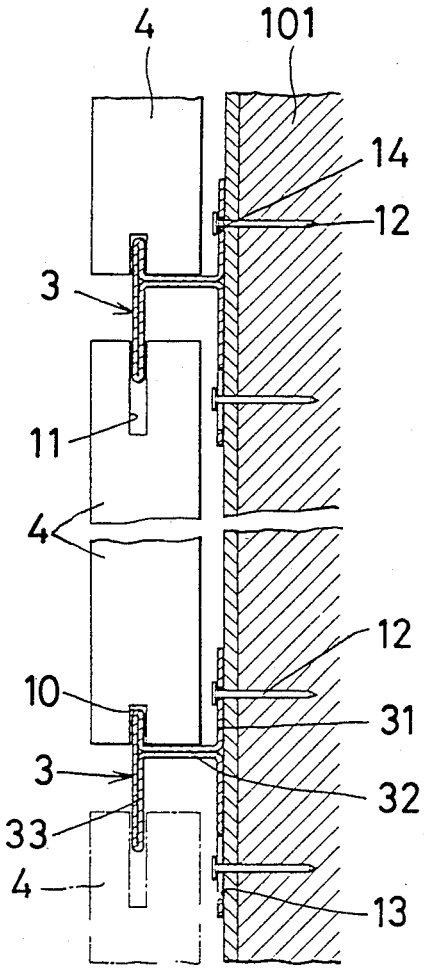
FIG.16
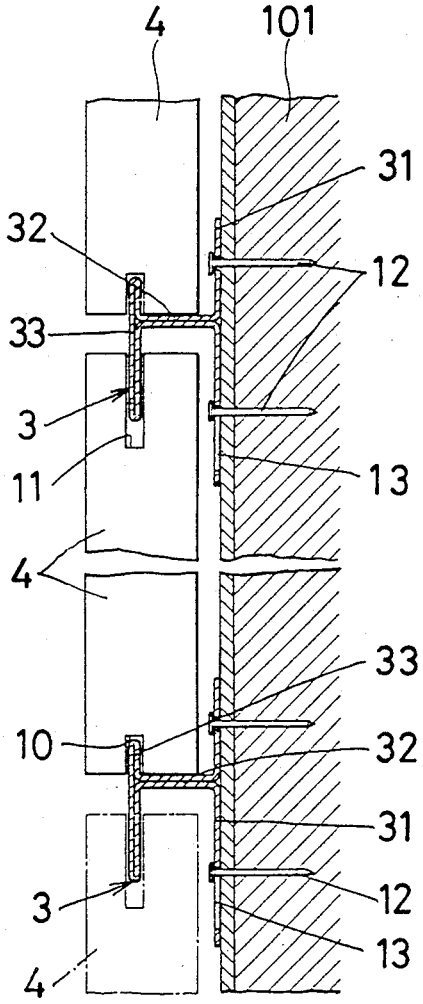

APPARATUS FOR TILE-SETTING

BACKGROUND OF THE INVENTION

1. Field of the Invention

The present invention relates to an apparatus or materials for setting tiles on the surface of plaster.

2. Description of the Prior Art

So far, ceramic tiles, marble tiles and scagliola tiles have been set one by one by means of mortar. No one has been farsighted enough to think of an apparatus which obviates the tediousness incidental to the conventional way of setting tiles.

SUMMARY AND OBJECTS OF THE INVENTION

It is an object of the present invention to provide an apparatus for tile-setting, comprising a plurality of vertical bars joined at regular intervals by a plurality of horizontal bars that serve as rests for the tiles. The horizontal bars can be spaced at desired intervals so that the framework of the present invention can be used for setting tiles of various sizes.

It is another object of the present invention to provide an apparatus for tile-setting which obviates the necessity of relying on the skill of a professional tile-setter.

With these objects in view, the invention will become apparent from the following detailed description, which will be more clearly understood in connection with the accompanying drawings.

BRIEF DESCRIPTION OF THE DRAWINGS

FIG. 14 is a front view thereof;

FIGS. 15 and 16 are enlarged vertical sections of the fifth embodiment of the present invention;

DETAILED DESCRIPTION OF THE PREFERRED EMBODIMENTS

Figure 1:
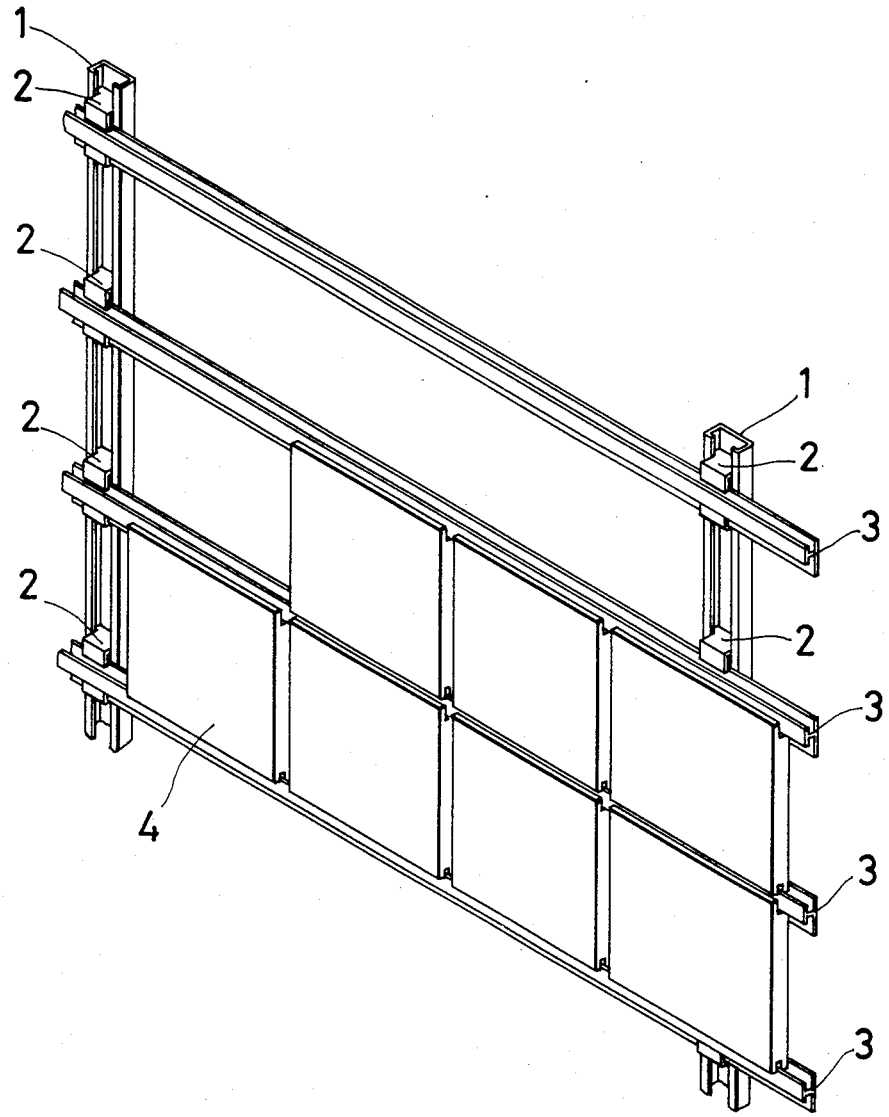
FIG. 1 is a perspective view of the first embodiment of the present invention, illustrating how the tiles are rested on the horizontal bars.

Referring now to FIG. 1, an apparatus in accordance with the present invention includes a plurality of vertical bars 1 made of metal and joined at regular intervals by a plurality of horizontal bars 3 that serve as rests for the tiles 4. Each horizontal bar 3 is held in place by a pair of horizontal bar holders 2 mounted on the adjacent vertical bars 1.

Figure 3:
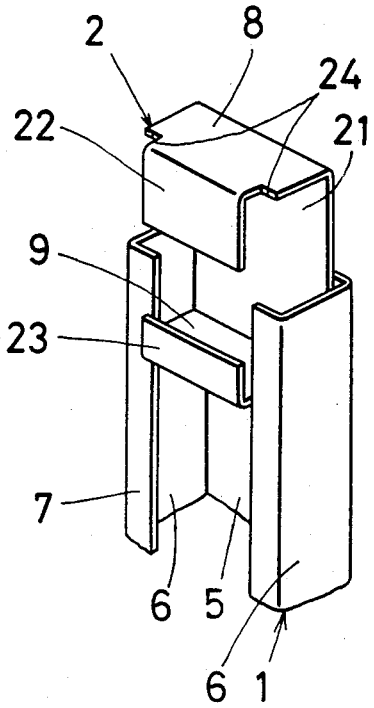
FIG. 3 is a fragmentary perspective view of a vertical bar in which a horizontal bar holder is being inserted.

Referring now to FIG. 3, the vertical bar 1 has a U-shaped section with a web 5 connecting two flanges 6. Members 7 inwardly stem from the flanges 6. The horizontal bar holder 2 also has a U-shaped section with a web 21 connecting upper and lower flanges 8 and 9. The width of the web 21 and the upper and lower flanges 8 and 9 is substantially equal to the distance between the internal surfaces of the flanges 6. The flanges 8 and 9 are provided with shoulders 24 in such a manner that the distance between the shoulders 24 and the internal surface of the web 21 is substantially made equal to the distance between the internal surface of the web 5 and the internal surfaces of the inward members 7. The end portions of the upper end lower flanges 8 and 9 are bent downwardly and upwardly so as to form downward and upward tongues 22 and 23, respectively.

The horizontal bar holder 2 is fitted into the vertical bar 1 in such a manner that the flanges 8 and 9 are made perpendicular to the flanges 6. When the horizontal bar holder 2 is fitted into the vertical bar 1 in this manner, the downward tongue 22 and the upward tongue 23 are allowed to project outwardly through the space left between the opposite edges of the inward members 7. The projection takes place to such an extent that some space is left between the internal surfaces of the downward tongue 22 and the upward tongue 23 and the external surfaces of the inward members 7. The horizontal bar holder 2 is secured to the vertical bar 1 either by means of screws 103 (FIG. 2) or by welding.

Figure 2:
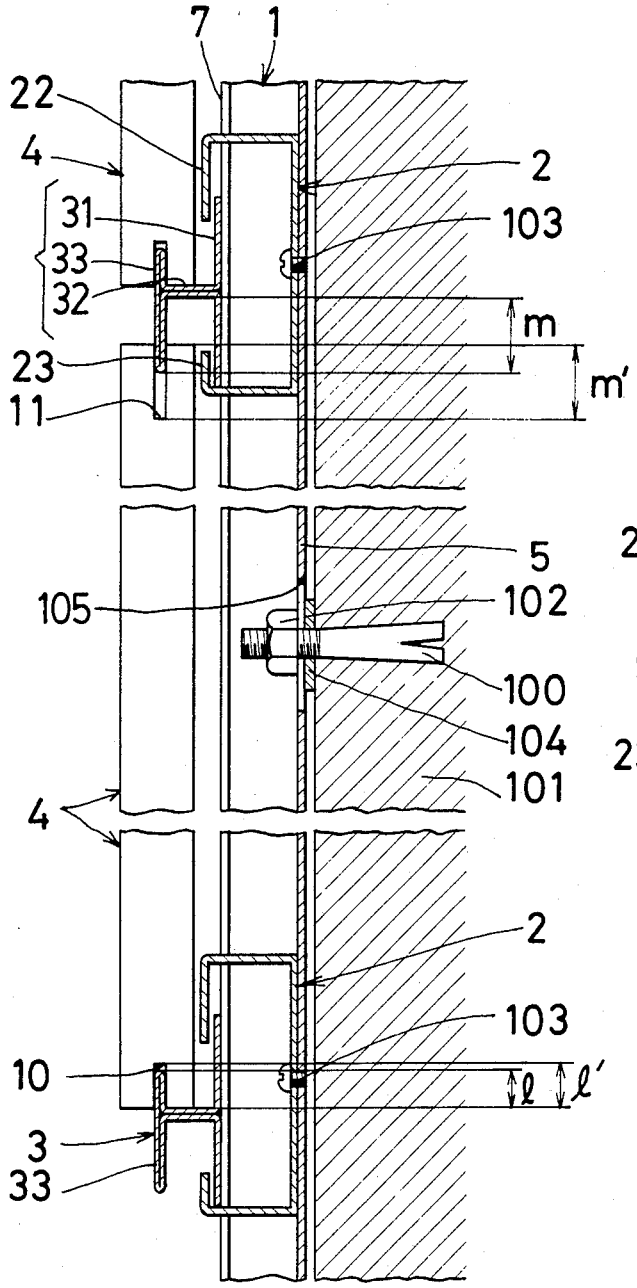
FIG. 2 is an enlarged vertical section thereof.

Referring now to FIG. 2, the horizontal bar 3 has an H-shaped section with a web 32 connecting two flanges 31 and 33. The flange 31 is adapted to fit in the space left between the internal surfaces of the downward tongue 22 and the upward tongue 23 and the external surfaces of the inward members 7. When the flange 31 is allowed to fit therein, the web 32 together with the flange 33 is allowed to project outwardly through the space left between the opposite edges of the downward tongue 22 and the upward tongue 23. Then some space is left between the internal surface of the flange 33 and the external surfaces of the downward tongue 22 and the upward tongue 23. The web 32 together with the upper half of the flange 33 serves as a rest for the upper tile 4, while the lower half of the flange 33 serves as a catch for the lower tile 4.

Referring now to FIGS. 6 to 11, the third and fourth embodiments of the present invention are different from the foregoing first and second embodiments in that the former dispense with the vertical bars 1 so as to allow the tiles 4 to be in closer proximity to the surface of the plaster or concrete panels 101. Consequently, the horizontal bar holder 2 of the third and fourth embodiments is different from that of the first and second embodiments in the following two points. Firstly, the former can dispense with the shoulders 24. Secondly, the distance between the web 21 and the tongues 22, 23 can be minimized in the former.

Figure 8:
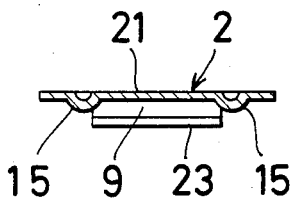
FIG. 8 is a horizontal sectional view of a horizontal bar holder used therein.
Figure 11:
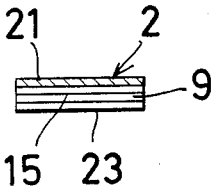
FIG. 11 is a horizontal sectional view of a horizontal bar holder used therein.
Figure 9:
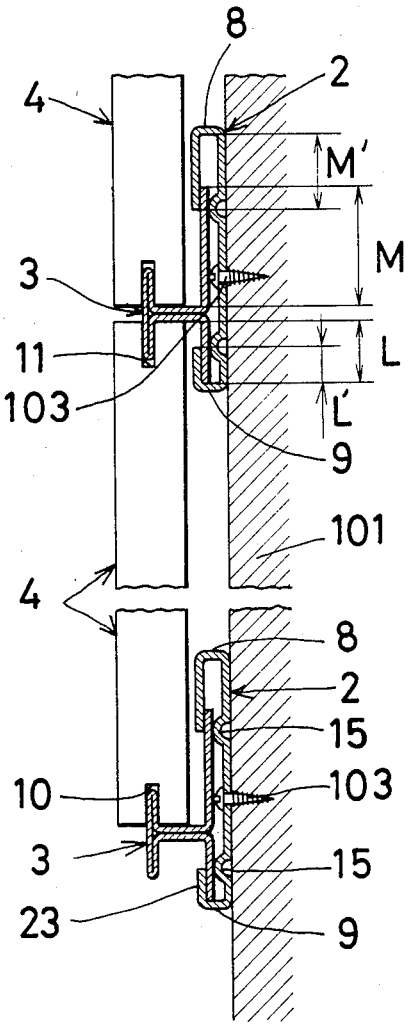
FIGS. 9 and 10 are enlarged vertical sections of the fourth embodiment of the present invention.
Figure 10:
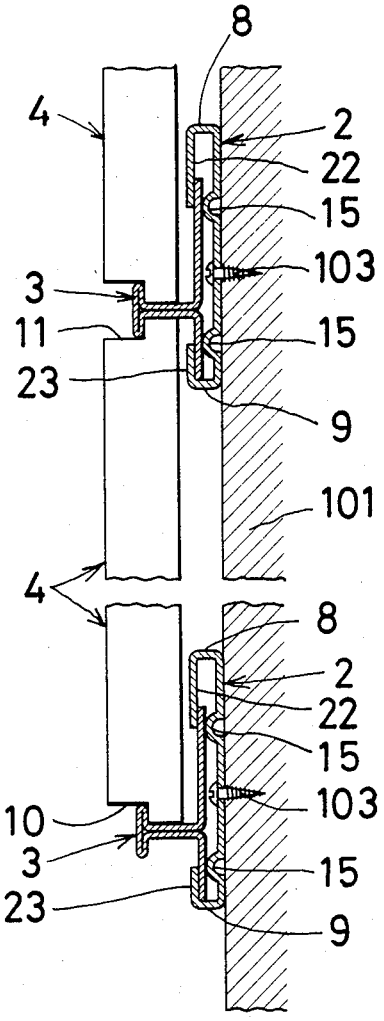
Figure 12:
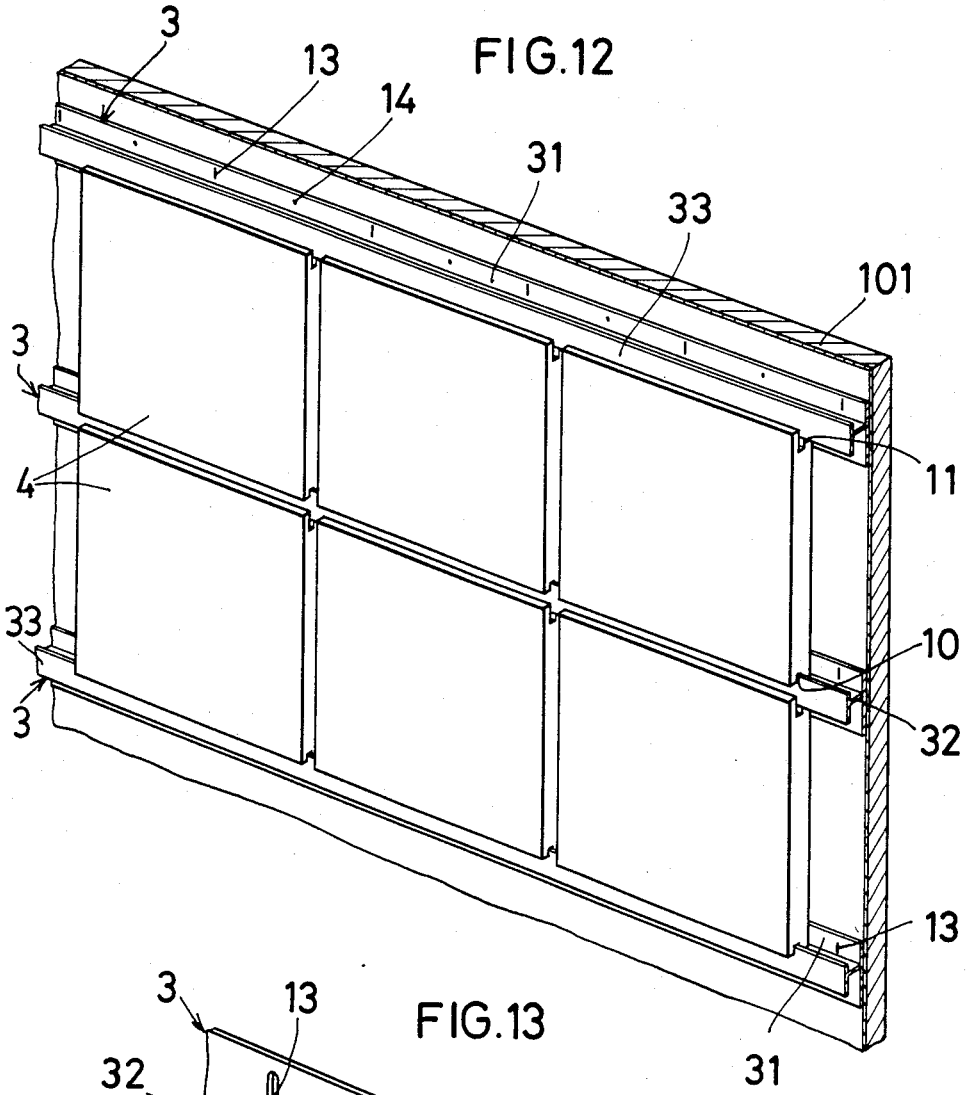
FIG. 12 is a perspective view of the fifth embodiment of the present invention.
Figure 13:
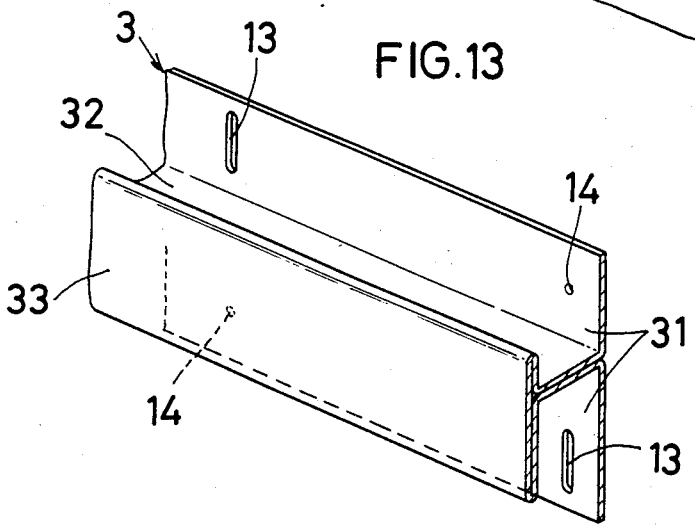
FIG. 13 is a fragmentary perspective view of a horizontal bar used therein.
Figure 17:
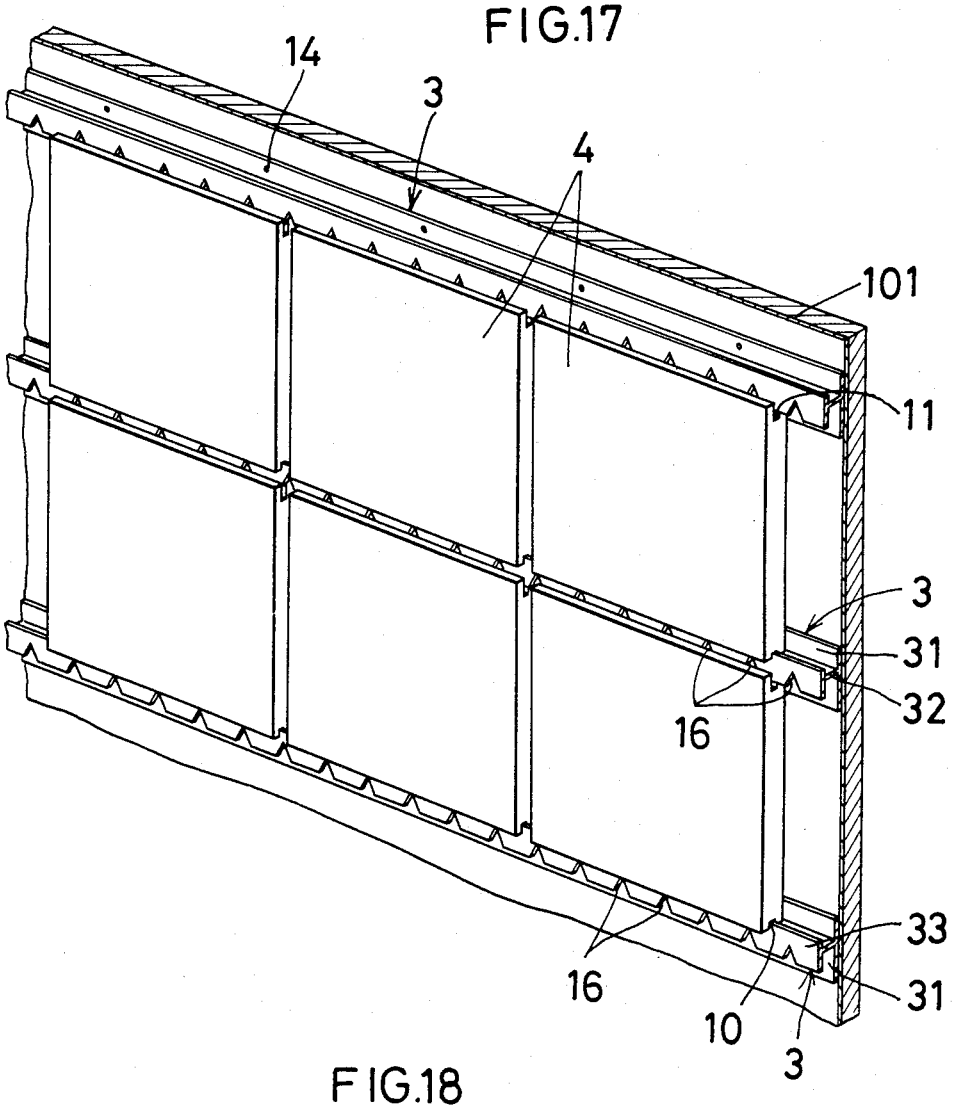
FIG. 17 is a perspective view of the sixth embodiment of the present invention.
Figure 18:
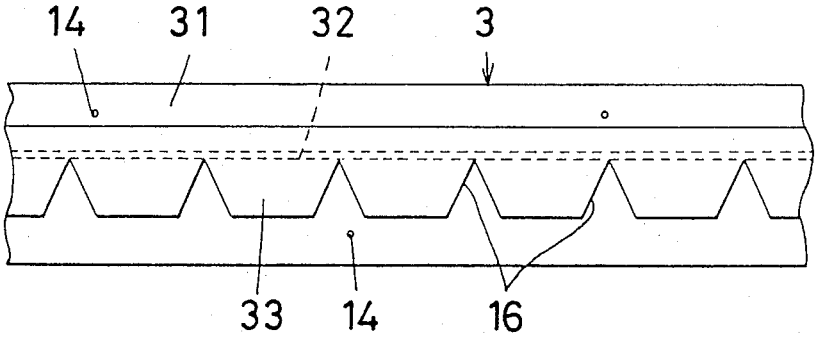
FIG. 18 is a front view thereof.

Because of the minimized distance between the web 21 and the tongues 22, 23, the horizontal bar holder 2 of the third and fourth embodiments requires a means for keeping the flange 31 apart from the head of the screw 103. This requirement is met by a pair of undulatory projections 15, best shown in FIGS. 8–10, provided on the internal surface of the web 21 with the head of the screw 103 between.

The horizontal bar holder 2 of the third embodiment is different from that of the fourth embodiment in that the undulatory projections 15 are provided perpendicularly to the flanges 8 and 9 in the former, while they are provided in parallel with the flanges 8 and 9 in the latter. choice being determined by economic constraints in light of the Referring now to FIGS. 12 to 21, the fifth to eighth embodiments of the present invention are different from all of the foregoing embodiments in that the former dispense not only with the vertical bars 1 but also with the horizontal bar holders 2 so as to allow the horizontal bars 3 to be directly nailed on the plaster or concrete panels 101 by means of nails 12, as shown in FIGS. 15 and 16, for example.

In case of the fifth embodiment shown in FIGS. 12 to 16, a first supply of nails 12 are driven through elongated holes 13 provided in the flange 31 so as to permit fine adjustment of the position of each horizontal bar 3 in the vertical direction. Then a second supply of nails 12 are driven through round holes 14 so as to fix the horizontal bars 3.

Figure 19:
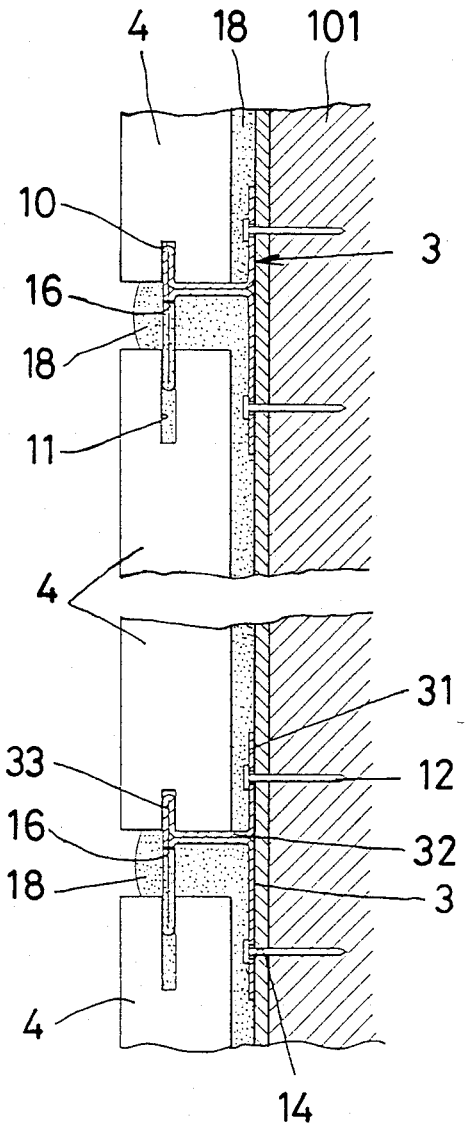
FIG. 19 is an enlarged vertical section thereof.
Figure 20:
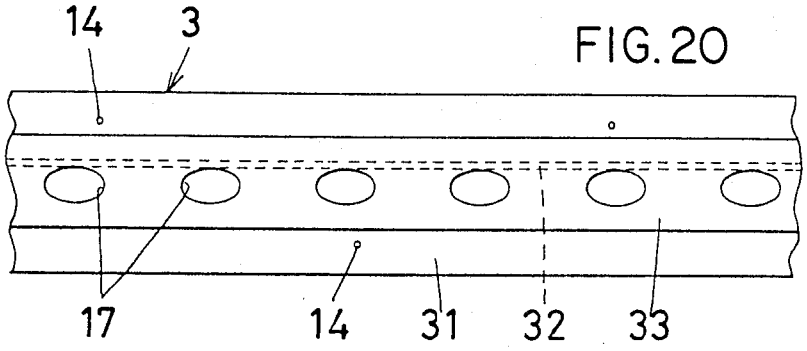
FIG. 20 is a front view of the seventh embodiment of the present invention.
Figure 22:
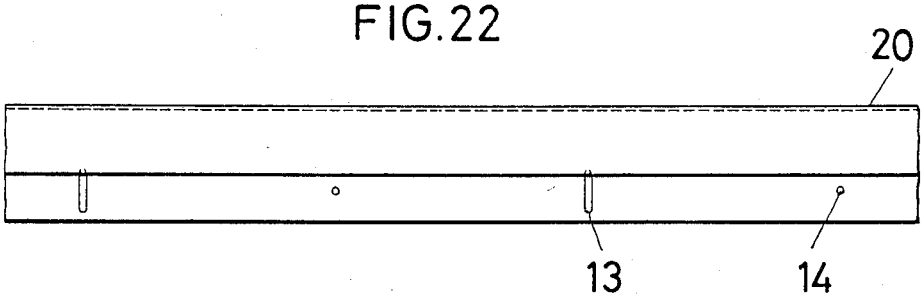
FIG. 22 is a front view of a top cover to be mounted on the upper ends of the tiles which constitute the uppermost row.

The sixth and seventh embodiments shown in FIGS. 17 to 20 are different from the fifth embodiment in the following two points. Firstly, the former are not provided with elongated holes 13. Secondly, the lower half of the flange 33 of the former is provided either with a plurality of notches 16 (FIGS. 17–19) or with a plurality of oval holes 17 (FIG. 20).

Figure 21:
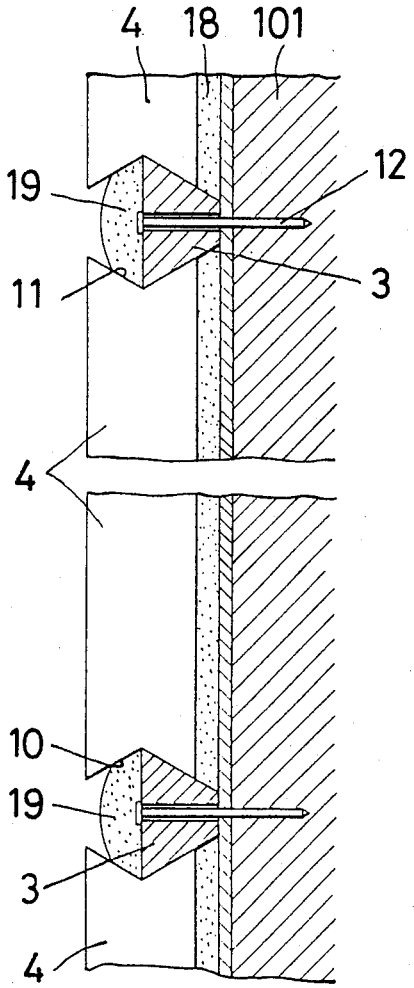
FIG. 21 is an enlarged vertical section of the eighth embodiment of the present invention.

The horizontal bar 3 of the eighth embodiment shown in FIG. 21 is different from that of the remaining embodiments in that the former has a trapezoidal section and is nailed on the Plaster or concrete panels 101 in such a manner that the trapezoidal section is tapered toward the plaster or concrete panels 101. The grooves 10 and 11 are V-shaped so as to fit on the inclined surfaces of the horizontal bar 3.

In operation, returning to FIG. 2, a plurality of vertical bars 1, in each of which horizontal bar holders 2 are already fitted, is secured to the surface of the plaster or concrete panels 101 at intervals of, e.g., 1 to 1.5 m by means of stud bolts 100 and nuts 102 in case of the first and second embodiments of the present invention. Washers 104 will be necessary if the surface of the plaster 101 is uneven. Elongated holes 105, which are provided in the web 5 of each vertical bar 1 and through which the stud bolts 100 are allowed to pass, permit fine adjustment of the position of the vertical bar 1 in its longitudinal direction.

The work of mounting a horizontal bar 3 on the adjacent horizontal bar holders 2 in the first to fourth embodiments of the present invention begins with inserting the upper half of the flange 31 in the space left between the internal surface of the downward tongue 22 and the external surfaces of the inward members 7. Then the lower half of the flange 31 is inserted in the space left between the internal surface of the upward tongue 23 and the external surfaces of the inward members 7.

Figure 4:
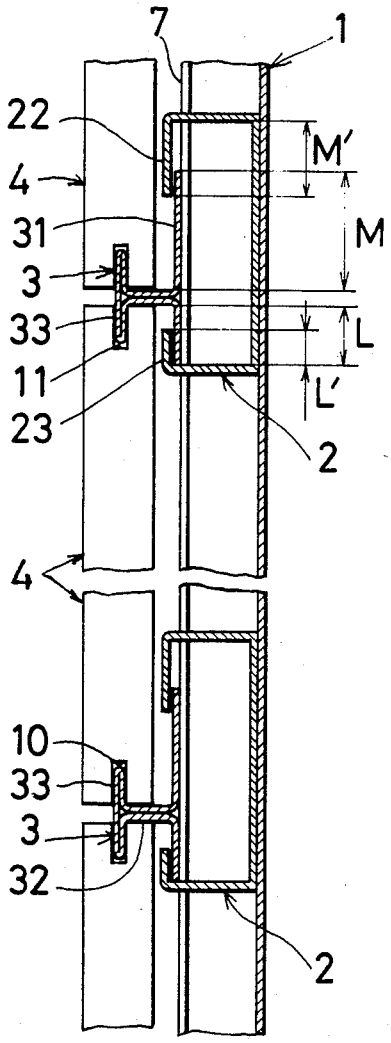
FIGS. 4 and 5 are enlarged vertical sections of the second embodiment of the present invention.

In order that the above-described way of mounting the horizontal bar 3 may be made feasible, as shown in FIG. 4, the vertical length M of the upper half of the flange 31 should be larger than the vertical length L of the lower half of the flange 31 or, in the alternative, the vertical length M′ of the downward tongue 22 should be larger than the vertical length L′ of the upward tongue 23 (see FIGS. 4 and 9).

If the horizontal bar 3 mounted on the adjacent horizontal bar holders 2 is excessively rickety, the space left between the upper half of the flange 31 and the external surfaces of the inward flanges 7 and the space left between the lower half of the flange 31 and the internal surface of the upward tongue 23 may be narrowed by striking the downward tongue 22 and the upward tongue 23 with a hammer. However, these spaces should not be narrowed to such an extent that the horizontal bar 3 is hindered from undergoing a vertical motion, especially in the second embodiment of the present invention.

Then the tiles 4 are mounted on the framework.

Figure 5:
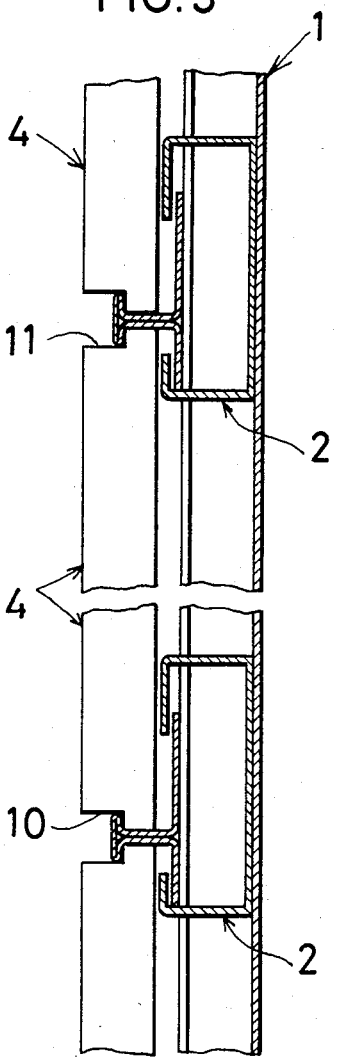
Figure 6:
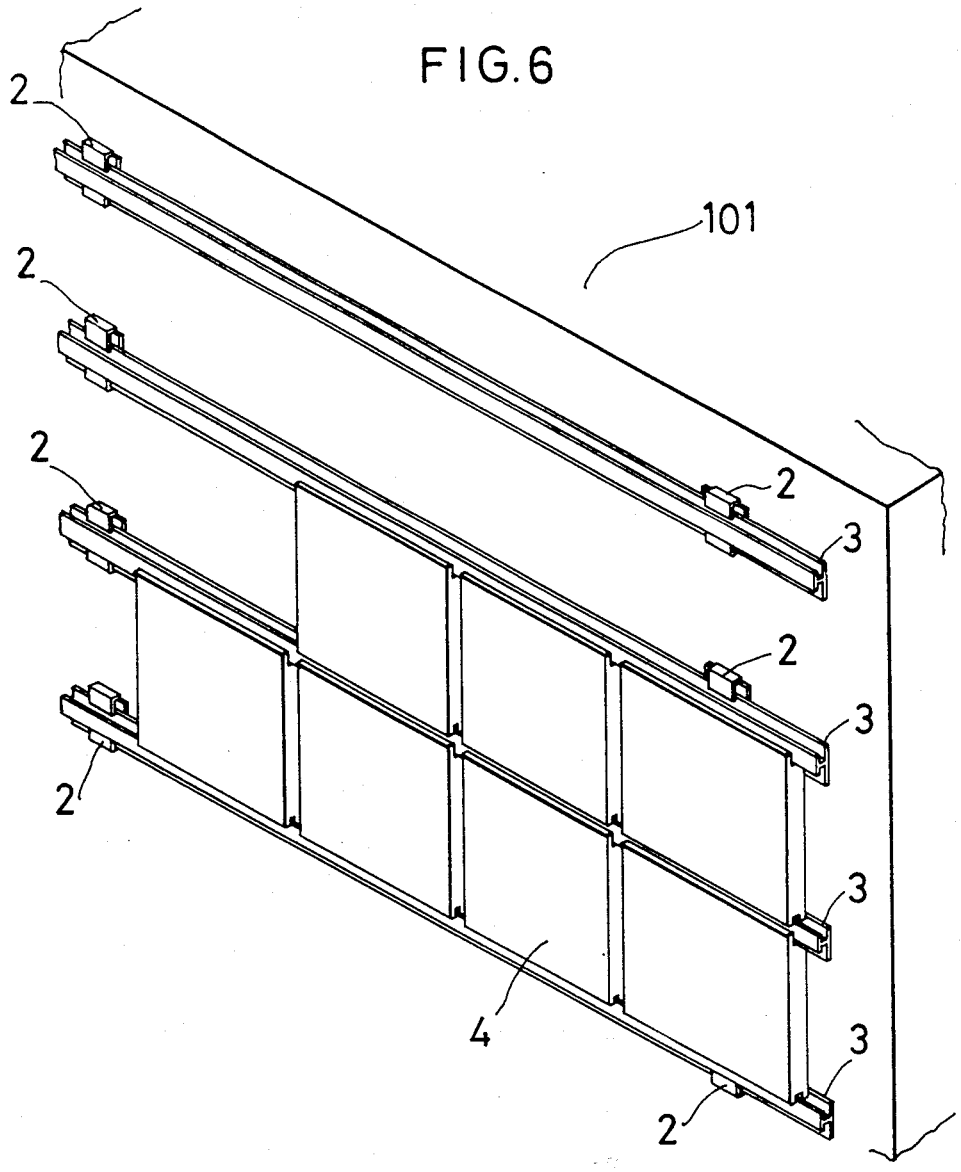
FIG. 6 is a perspective view of the third embodiment of the present invention.

In case of the second embodiment shown in FIGS. 4 and 5 and the fourth embodiment shown in FIGS. 9 and 10, the work of mounting a tile 4 on the framework begins with lifting up the horizontal bar 3, which constitutes the second rung from the bottom, so as to allow the flange 31 to slide on the external surfaces of the inward flanges 7. Then the tile 4 is rested on the web 32 of the horizontal bar 3, which constitutes the lowest rung, by allowing the upper half of the flange 33 of this horizontal bar to fit into a groove 10 provided in the lower end of the tile 4. Then the horizontal bar 3, which constitutes the second rung from the bottom, is brought down so as to allow the lower half of the flange 33 of this horizontal bar 3 to fit into a groove 11 provided in the upper end of the tile 4.

Figure 7:
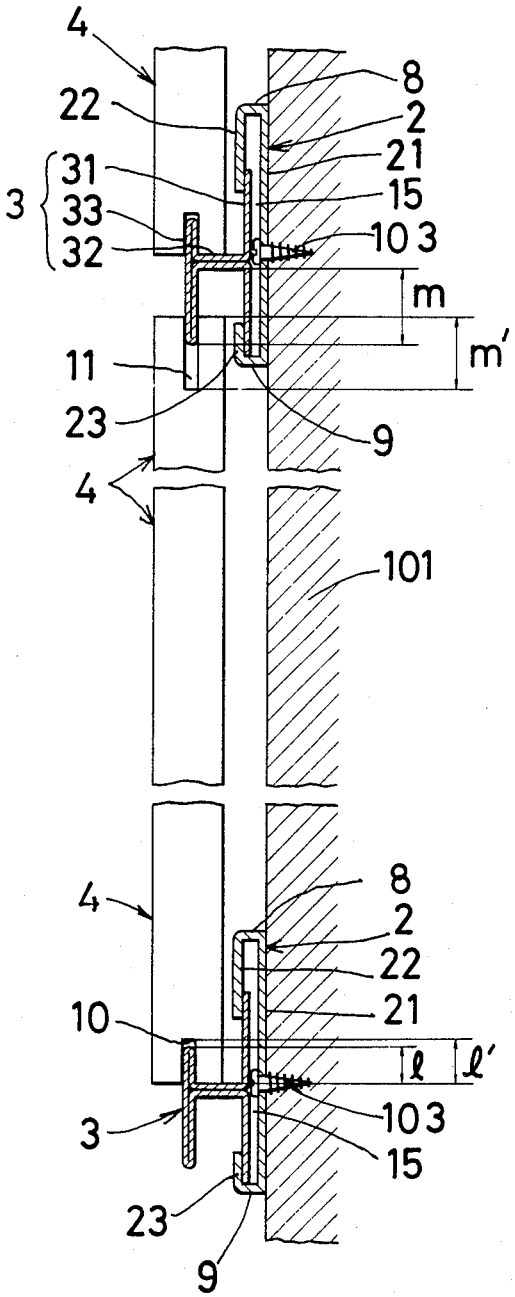
FIG. 7 is an enlarged vertical section thereof.

In case of the first embodiment shown in FIG. 2, the third embodiment shown in FIG. 7 and the fifth embodiment shown in FIGS. 15 and 16, the work of mounting a tile 4 on the framework is done without subjecting the horizontal bar 3, which constitutes the second rung from the bottom, to a vertical motion. This work begins with allowing the lower half of the flange 33 of the horizontal bar 3, which constitutes the second rung from the bottom, to fit into the groove 11. Then the upper half of the flange 33 of the horizontal bar 3, which constitutes the lowest rung, is allowed to fit into the groove 10. In order that this way of mounting the tile 4 on the framework may be made feasible, the vertical length m of the lower half of the flange 33 should be larger than the vertical length l of the upper half of the flange 33 or, in the alternative, the depth m′ of the groove 11 should be larger than the depth l′ of the groove 10.

When the necessary number of tiles 4 have been mounted on the framework, the space left between the tiles 4 and the plaster or concrete panels 101 is filled with mortar or formed plastics 18 such as polyurethane foam shown only in FIG. 19. In case of the sixth and seventh embodiments shown in FIGS. 17 to 20, the mortar or foamed plastics 18 comes oozing out of the space between the tiles 4 and the plaster or concrete panels 101 through the notches 16 or the oval holes 17 as shown in FIG. 19. In case of these embodiments, therefore, the spaces between the adjacent surfaces of the tiles 4 need not be filled and finished with a special caulking material. In case of the sixth embodiment shown in FIGS. 17 to 19, the mortar or foamed plastics 18 flows into the grooves 11 and, after hardening, serves to prevent the tiles 4 from being vertically jolted at the time, e.g., of an earthquake.

In case of the eighth embodiment shown in FIG. 21, the spaces between the adjacent surfaces of the tiles 4 are filled and finished with a caulking material 19.

Figure 23:
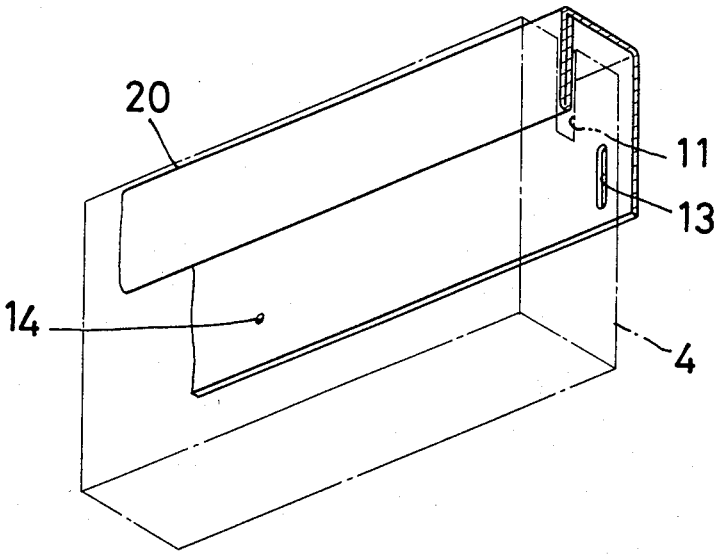
FIG. 23 is a fragmentary perspective view thereof.

Then a top cover 20 is mounted on the upper ends of the tiles 4 which constitute the uppermost row (see FIG. 23).

While several embodiments of the present invention have been disclosed, it is to be understood that they are described by way of example only and not in a limiting sense, the scope of the present invention being determined by the following claims.

What I claim is:

1. An apparatus for setting a plurality of tiles having rectangular longitudinal grooves in a pair of opposite sides, comprising:

a plurality of horizontal bars, each having an H-shaped section with a first web means for connecting two flanges, a plurality of horizontal bar holders having a second web means for connecting upper and lower tongues between which one of said two flanges is gripped, said upper tongue having a vertical length longer than the vertical length of said lower tongue, and means, provided in the second web means, for allowing securement of each of the horizontal bar holders to a surface of plaster.

2. An apparatus as set forth in claim 1, wherein:

said one of the two flanges gripped by the upper and lower tongues has an upper half and a lower half, said upper half having a vertical length longer than the vertical length of said lower half.

3. An apparatus for setting a plurality of tiles having rectangular longitudinal grooves in a pair of opposite sides, comprising:

a plurality of horizontal bars, each having an H-shaped section with a first web means for connecting two flanges, a plurality of horizontal bar holders having a second web means for connecting upper and lower tongues between which one of said two flanges is gripped, said upper tongue having a vertical length longer than the vertical length of said lower tongue, a plurality of vertical bars having a C-shaped section with a third web means for connecting opposite longitudinal edges, means, provided in the second web means, for allowing securement of each of said horizontal bar holders to said vertical bars, and means, provided in the third web means, for allowing securement of each of said vertical bars to a surface of plaster.

* * * * *